US006305032B1

(12) United States Patent
Jones

(10) Patent No.: US 6,305,032 B1
(45) Date of Patent: Oct. 23, 2001

(54) TOILET SEAT LIFTING DEVICE

(76) Inventor: Emory G. Jones, 246 Alfred St., Savannah, GA (US) 31408

( * ) Notice: Subject to any disclaimer, the term of this patent is extended or adjusted under 35 U.S.C. 154(b) by 0 days.

(21) Appl. No.: 09/515,066

(22) Filed: Feb. 28, 2000

(51) Int. Cl.[7] ..... A47K 13/10
(52) U.S. Cl. ..... 4/246.1; 4/661
(58) Field of Search ..... 4/246.1, 661, 253, 4/254, 234, 237

(56) References Cited

U.S. PATENT DOCUMENTS 4,979,238 * 12/1990 Clark ..... 4/246.1
5,220,693 * 6/1993 Paglia ..... 4/246.1
5,619,758 * 4/1997 Burkett ..... 4/246.1
5,713,084 * 2/1998 Greco ..... 4/246.1
5,729,839 * 3/1998 Bigelow ..... 4/246.1
5,737,778 * 4/1998 Black ..... 4/246.1
5,829,067 * 11/1998 Smith ..... 4/246.1

* cited by examiner

*Primary Examiner*—Charles R. Eloshway

(57) ABSTRACT

A toilet seat lifting device is provided for the manually lifting and lowering of a toilet seat without requiring the user to actually touch the toilet seat or actually touching any part attached to the toilet seat. This toilet seat lifting device is also provided for raising and lowering said toilet seat for persons with physical disabilities who have difficulty in bending to raise or lower a toilet seat. It is also provided as a sanitary way of raising and lowering a toilet seat for those without sight. It is a two piece device, one piece being a lifting knob that is permanently attached to one side of the underside of a toilet seat. The other part of the device is in the form of a wand having a manually graspable portion at one end and a hook at the opposite end that is used to cradle the neck part of the lifting knob, granting the user complete control of the toilet seat when lifting or lowering said toilet seat.

1 Claim, 2 Drawing Sheets

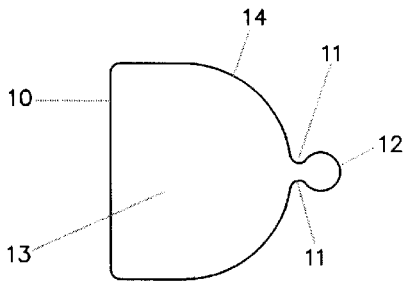
FIG. 1–A
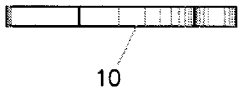
FIG. 1–B
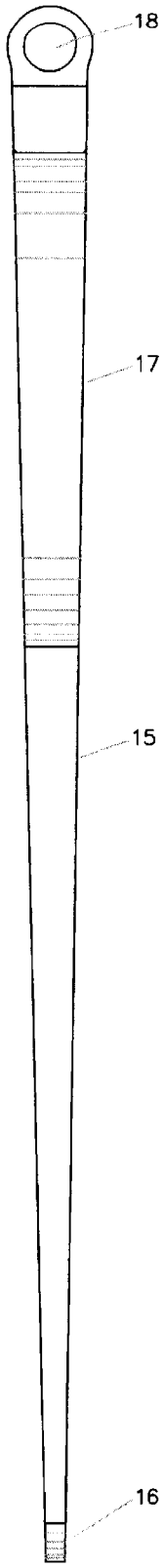
FIG. 2–A
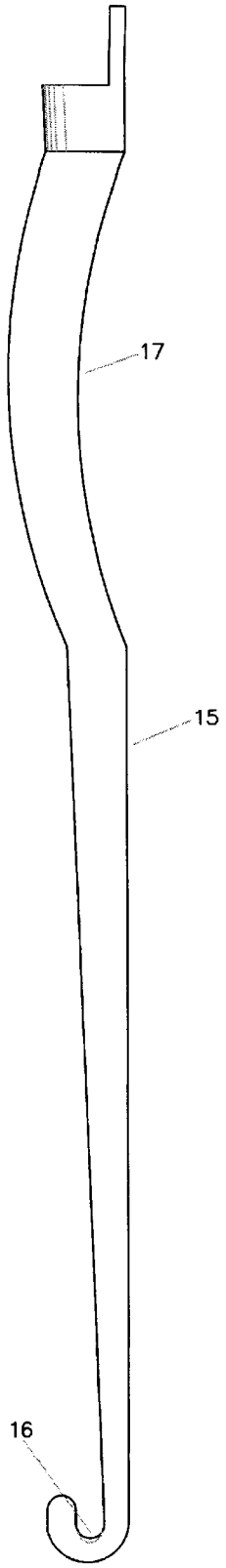
FIG. 2–B

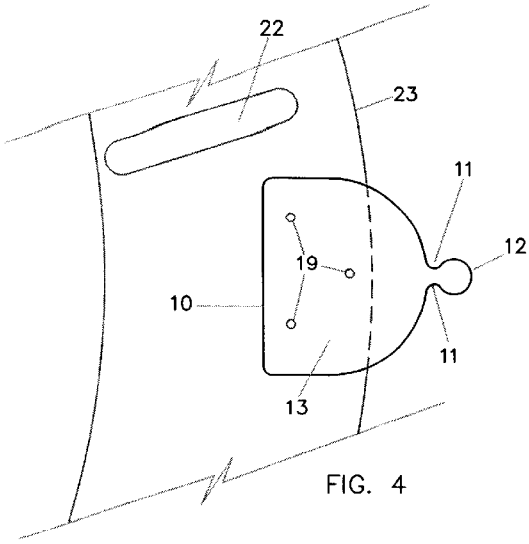
FIG. 4
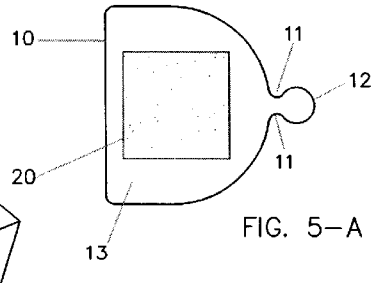
FIG. 5–A
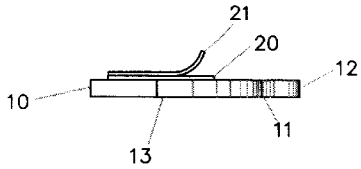
FIG. 5–B
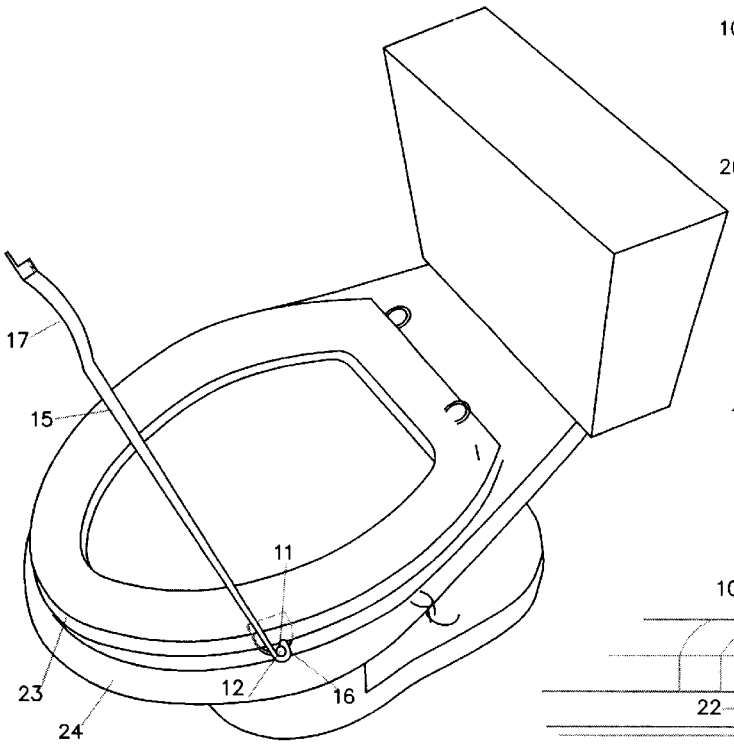
FIG. 3
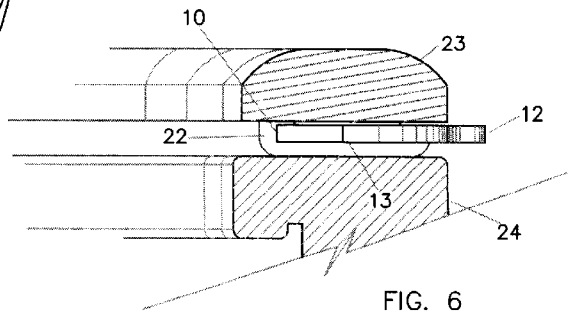
FIG. 6

TOILET SEAT LIFTING DEVICE

BACKGROUND

1. Field of Invention

This relates to a toilet seat lifting device which permits the user to raise and lower the toilet seat without necessitating manual touching of said seat or any attachment of the seat. This provides for increased sanitation, particularly at public toilet facilities. Advantageously, it also provides a sanitary means of raising and lowering a toilet seat for the less fortunate, those with physical disabilities that prevent them from bending as well as those without sight, thereby maximizing the universality of its utilization.

2. Description of Prior Art

Users of toilet commodes, particularly at public locations, are oftentimes concerned about the possible spreading of disease by touching the toilet seat, which is obviously necessary in order to raise and lower said seat. The desire to avoid such manual touching has been previously addressed with only a limited degree of acceptability. Several previously proposed solutions have required an additional element to be physically attached to the toilet seat. Typical of such prior toilet seat lifers are U.S. Pat. Nos. 4,129,907, 4,742,582, 4,875,251, and 5,027,472.

Such lifers, as aforementioned, due to their continual proximity to the toilet seat, are apt to become soiled over an extended period of time. Hence, they can subject the user to the same sanitary concerns of physically grasping the toilet seat itself.

U.S. Pat. No. 2,758,315 is directed to a similar type of lifter for this cover portion of the toilet seat assembly, which disadvantageously also requires physical attachment to the cover.

U.S. Pat. No. 5,058,215 is directed to a toilet seat lifter which is intended to be connected to the underside of toilet seat by double coated adhesive tape. Due to its continued close proximity to the toilet seat, such a lifter can tend to become soiled over a period of time. Further, the adhesive securement might weaken, causing disengagement of the lifter, rendering it useless, and thereby again necessitating manual touching of the toilet seat.

U.S. Pat. No. 4,979,238 discloses a combination toilet seat lifter and flusher in which the toilet seat must be inserted in a narrow opening between an "L-shaped" round tube and the supporting holder. This would require a certain amount of dexterity, and limited versatility, since the unit would have to be customized in accordance with the thickness of the toiled seat.

U.S. Pat. No. 4,835,799 is directed to a rather complex clamping member having jaw members which must engage the toiled seat.

U.S. Pat. No. 5,737,778 discloses a rather awkward toilet seat lifting system fish tail like appendage that offers no real control over the seat when it is in motion, consequently, over a period of time, damage could occur to the toilet bowl and the water reservoir from the impact of the uncontrollable toilet seat.

Therefore, the myriad of prior proposals for avoiding the manual grasping of the toilet seat have demonstrated several disadvantages resulting in their lack of acceptability.

OBJECTS AND ADVANTAGES

It is an object of the invention to provide an improved toilet seat operating mechanism.

Another object and definite advantage of the invention is to provide a sanitary toilet seat operating mechanism which is simple in construction, economical to manufacture and simple and efficient to use.

A definite advantage of the invention is its simplicity and efficiency. The invention is so efficient, simple and easy to use that persons without sight will have no difficulty in mastering its use and versatility.

With the above and other objects in view, the present invention consists of the combination and arrangement of parts hereinafter more fully described, illustrated in the accompanying drawings and more particularly pointed out in the appended claims it being understood that the changes may be made in the form, size proportions and minor details of construction without departing from the spirit of sacrificing any of the advantages of the invention.

DRAWING FIGURES.

FIG. 1(A) is a bottom view of inventions lifting knob.

FIG. 1(B) is a side view of the same lifting knob.

FIG. 2(A) is a side view of the elongated wand.

FIG. 2(B) is a front view of the wand

FIG. 3 is an isometric view of the toilet seat operating device in combination with a toilet according to the invention.

FIG. 4 is a partial bottom view of the lifting knob on the toilet seat.

FIG. 5(A) is a bottom view of the lifting knob depicting the adhesive pad.

FIG. 5(B) is a side view of the lifting knob illustrating the adhesive pad and the protective paper shield.

FIG. 6 is a partially cutaway sectional front views of portions thereof.

REFERENCE NUMERALS IN DRAWINGS

10 entire one piece lifting knob
11 neck of lifting knob
12 head of lifting knob
13 base of lifting knob
14 tapered side
15 elongated wand
16 hook
17 graspable end
18 hole
19 counter sunk screw holes
20 adhesive
21 protective paper covering
22 toilet seat bumper
23 toilet seat
24 commode

SUMMARY

The present invention provides an inexpensive and simple device, having substantial universitality of application, ease of use, and a high degree of sanitation. More specifically, a toilet seat lifting knob is attached to the underside of a toilet seat and a seperate elongated wand is used to interact with said lifting knob. That is, the wand is not physically attached to the toilet seat. The wand has an elongated handle, with a manually graspable member at one end . The other end includes a hook that is manually engaged with the lifting knob. The wand is in one piece. This arrangement obviates the necessity of directly touching the seat. One can do without feeling uncomfortable under an assumption that the seat has been stained or soiled by others.

I stress the ease of use of the invention in its efficiency and simplicity for it affords all who are concerned about sanitation and proper toilet seat etiquette with a means for lifting and lowering a toilet seat. I emphasize the word all because the invention is so easy to use that it can simply and easily be mastered by persons even those without sight.

The invention is also advantageous to the physically disabled who have problems with bending as well as those who have difficulty in keeping a steady hand.

Accordingly, it is the primary object of the present invention to provide a sanitary means of lifting and lowering toilet seats for one and all.

DESCRIPTION—FIGS. 1 to 6

Referring now to FIG. 1(A) to 1(B), is a bottom view of 10 the complete, one piece, lifting knob that is to attach to the underside of a toilet seat, included is 14 the tapered sides of 10 leading to 11 the neck of the lifting knob and 12 the head as is the knob of the lifting knob and then 13 the base of the lifting knob, and 1(B) is a side view of 10 said lifting knob.

Referring now to FIG. 2(A) to 2(B), is 15 a side view of the entire elongated wand with 17 a graspable end of said wand and 16 the hooked end of the wand, then 18, a hole for hanging the wand onto a wall mounted hook when not in use, this wall mounted hook is not depicted, 2(B) is a front view of same wand.

Referring now to FIG. 3, is an isometric view of 24 a commode with 23 a hinged toilet seat and a partial view of 10 the lifting knob with only 11 the neck and 12 the head actually viewable, 16,the hooked end of the wand is shown cradled around 11 the neck of the lifting knob. Now 15, the wand is shown in relative position of the commode to either start the lifting procedure or at the end of the lowering procedure. The wand, 15, is guided by the seat, 23, itself onto 11 the neck of the lifting knob and is prevented from slipping off of the lifting knob by 12 the head of said lifting knob.

Referring now to FIG. 4, is a partial view of 23, a raised toilet seat, illustrating, 22 the bumper of the toilet seat and its approximation to 10 the lifting knob. In this view, 19 is observed as predrilled screw holes for permanently securing 10 the lifting knob to the underside of 23 the toilet seat. The base, 13 is shown attached to said seat, 23. Again the neck 11 and the head 12 are illustrated.

Referring now to FIG. 5(A) is 10 the lifting knob shown as before in FIG. 4 but with the addition of 20 an adhesive layer depicted.

Referring now to FIG. 5(B) is a side view of lifting knob 10 to illustrate 20 the adhesive layer on the bottom of the base, 13 of 10 the lifting knob and 21 a protective paper covering to shield the adhesive 20 until time for it to be put into use.

Referring now to FIG. 6 is a partially cutaway sectional front view of 23 the toilet seat, 24 the commode, and the seat bumper 22 concealing the base 13 of the lifting knob. The neck 11 and the head 12 are shown extending out from the side of 23 the toilet seat and the neck 11 is shown accessible to the hook 16.

Operation—FIGS. 1(A), 2(A) 3, 4, 5(A)

The manner of using the toilet seat lifting device to raise and lower a toilet seat is discussed. Namely, one first must attach the lifting knob, 10, to the underside, either side, of a toilet seat, 23. This may be achieved by using either the adhesive, 20 or by the use of screws in the holes supplied, 19 or by the use of both the adhesive 20 and screws as is suggested to permanently secure the lifting knob, 10 to the seat, 23.

With the lifting knob, 10 securely attached one has to but grasp the lifting wand, 15 by the graspable end, 17 and with the hook, 16 facing the lifting knob, 10 simply cradle the neck, 11 of the lifting knob with the hook, 16 and maneuver the seat as desired. In FIG. 4 it is obvious as to how the wand, 15 will slide along the seat, 23 and then along the tapered side, 14 of the lifting knob, 10 and rest effortlessly against the neck, 11 of the lifting knob and then with a lifting motion the hook, 16 will fit into a cradled position around the neck, 11.

CONCLUSION, RAMIFICATIONS, AND SCOPE

Accordingly, the reader will see that the simplicity and ease of use of this invention can be used to sanitarily raise and lift a toilet seat by most people regardless of physical disabilities and offers a convenience that has long been needed in at least all public facilities.

The invention is definitely efficient, practical and simple to use but it also intrigues and is actually fun to use assuring that toilet facilities that offer said invention will save wear and tear on the commodes for many have been damaged from the sudden impact of seats crashing against the bowls and water tanks. This happens all to often when people use a foot or a piece of paper or the like to give the seat a start on its trek either down or up.

Although the description above contains many specificities, these should not be construed as limiting the scope of the invention but as merely providing illustrations of some of the presently preferred embodiments of the invention. For example, the wand can have other shapes, such as circular, oval, triangular, etc,; and the base of the lifting knob might be shaped some what different.

Thus the scope of the invention should be determined by the appended claims and their legal equivalents, rather than by the examples given.

I claim:

1. A two-piece unit for raising and lowering a toilet seat, comprising:

(a) a one-piece lifting knob consisting of:

two flat surfaces comprising a top surface and a bottom surface and having two sides and two ends;

an adhesive coating on the top surface for adhering to the bottom of the toilet seat;

at least one hole extending through the top and bottom surfaces for receiving a screw therethrough;

one of the ends having sides tapering inwardly to form a neck and then flaring outwardly to form a flat, oblong head; and (b) an elongated wand having opposed first and second sides and first and second ends, the opposed first and second sides tapering from the first end to the second end, the first end forming a handle and the second end having a hook shape, wherein, the second end of the wand is engaged with the lifting knob to thereby raise and lower the toilet seat, the tapering sides of the one end of the lifting knob guiding the second end of the wand onto the neck, the flat, oblong head of the lifting knob acting as a stop to maintain the second end of the wand on the neck when engaged therewith.

* * * * *